US011107629B2

(12) United States Patent
Oki et al.

(10) Patent No.: US 11,107,629 B2
(45) Date of Patent: Aug. 31, 2021

(54) MOLD APPARATUS FOR MANUFACTURING A COIL COMPONENT

(71) Applicant: SUMIDA CORPORATION, Tokyo (JP)

(72) Inventors: Juichi Oki, Natori (JP); Tomohiro Kajiyama, Natori (JP)

(73) Assignee: SUMIDA CORPORATION

( * ) Notice: Subject to any disclaimer, the term of this patent is extended or adjusted under 35 U.S.C. 154(b) by 519 days.

(21) Appl. No.: 15/988,686

(22) Filed: May 24, 2018

(65) Prior Publication Data

US 2018/0268995 A1 Sep. 20, 2018

Related U.S. Application Data

(62) Division of application No. 15/238,843, filed on Aug. 17, 2016, now Pat. No. 10,032,558.

(30) Foreign Application Priority Data

Aug. 19, 2015 (CN) ..... 201510512779.X

(51) Int. Cl.
*H01F 41/04* (2006.01)
*H01F 41/00* (2006.01)
(Continued)

(52) U.S. Cl.
CPC ..... *H01F 41/04* (2013.01); *H01F 41/005* (2013.01); *H01F 41/0246* (2013.01); *H01F 2017/048* (2013.01)

(58) Field of Classification Search
CPC ..... H01F 41/005; H01F 41/0246; H01F 41/04
See application file for complete search history.

(56) References Cited

U.S. PATENT DOCUMENTS 4,279,854 A * 7/1981 Blaszkowski ..... B29C 33/123 249/83
4,653,957 A * 3/1987 Smith ..... E01C 19/38 404/114
(Continued)

FOREIGN PATENT DOCUMENTS

CN 102737802 A 10/2012
CN 102810392 A 12/2012
(Continued)

OTHER PUBLICATIONS

Extended Search Report for EP Application No. 16183295.1, dated Jan. 2, 2017 (9 pages).
(Continued)

*Primary Examiner* — James Sanders
(74) *Attorney, Agent, or Firm* — Harness, Dickey & Pierce, P.L.C.

(57) ABSTRACT

A mold apparatus is provided for manufacturing a coil component. The mold apparatus includes a support plate, a die on the support plate, a lid, and a press member that presses the lid toward the support plate. The die has a peripheral side wall defining an opening opposite the support plate. The coil component is placeable in an inner space of the die interior of the side wall. The lid is insertable via the opening into the inner space with an outer peripheral edge of the lid slidably received by the side wall of the die.

12 Claims, 7 Drawing Sheets

(51) Int. Cl.
*H01F 41/02* (2006.01)
*H01F 17/04* (2006.01)

(56) References Cited

U.S. PATENT DOCUMENTS

| | | | | |
|---|---|---|---|---|
| 5,672,363 | A * | 9/1997 | Sagawa | B22F 3/003 264/313 |
| 7,230,514 | B2 * | 6/2007 | Brunner | H01F 3/08 148/100 |
| 2006/0186975 | A1 | 8/2006 | Wang | |
| 2010/0134233 | A1 * | 6/2010 | Wang | H01F 17/045 336/192 |
| 2011/0005064 | A1 | 1/2011 | Klesyk et al. | |
| 2013/0328656 | A1 | 12/2013 | Sakamoto | |
| 2014/0266541 | A1 | 9/2014 | Sakamoto et al. | |
| 2015/0270064 | A1 | 9/2015 | Sakamoto et al. | |
| 2016/0075058 | A1 | 3/2016 | Takahashi et al. | |

FOREIGN PATENT DOCUMENTS

| | | | |
|---|---|---|---|
| CN | 103915236 | A | 7/2014 |
| CN | 104051129 | A | 9/2014 |
| CN | 104269262 | A | 1/2015 |
| EP | 2779182 | A2 | 9/2014 |
| WO | WO-2015-150274 | A1 | 10/2015 |

OTHER PUBLICATIONS

First Chinese Office Action for CN App. No. 201510512779.X, dated Sep. 28, 2017 (15 pages).
Chinese Search Report for CN App. No. 201510512779.X, dated Sep. 28, 2017 (2 pages).

* cited by examiner

MOLD APPARATUS FOR MANUFACTURING A COIL COMPONENT

CROSS REFERENCES TO RELATED APPLICATIONS

This is a divisional patent application of U.S. application Ser. No. 15/238,843, filed on Aug. 17, 2016, and claims priority to Chinese Patent Application No. 201510512779.X, filed on Aug. 19, 2015, which are both expressly incorporated by reference herein in their entireties.

BACKGROUND OF THE INVENTION

Field of the Invention

The present invention relates to a manufacturing method of a coil component and a mold apparatus for manufacturing the coil component.

Description of the Related Art

There have been proposed various kinds of coil components each of which includes a magnetic core and a winding-wire coil. Among such coil components, there exists a component in which a coil formed by winding a rectangular wire or the like is attaching onto a magnetic-body core formed by a magnetic-body and which is further provided with a magnetic cover portion which covers those members (see Patent-document 1: Chinese unexamined patent publication No. 104051129). This magnetic cover portion is formed by filling the inside of a mold with a slurry-like or putty-like admixture which is obtained by mixing metal-made magnetic powders and a resin and by adding a solvent, and then, by employing a mold-forming using a magnetic material.

SUMMARY OF THE INVENTION

Meanwhile, it is required for the constitution as mentioned above that filling defect of the admixture would not occur at the periphery or the like of the coil on an occasion of mass-producing the coil components. For that reason, it is conceivable to pressurize the admixture. However, the admixture mentioned above is inferior in the fluidity and therefore, even if the admixture thereof is pressurized, there is a fear that a place which is not sufficiently filled with the admixture (filling defect) may be caused in the inside of the mold. In that case, it becomes a situation in which quality fluctuation of the coil components is caused.

The present invention was invented in view of such a problem and is addressed to providing a manufacturing method of a coil component and a mold apparatus for manufacturing the coil component in which it is possible to decrease the filling defect of the admixture.

The present invention is characterized by a manufacturing method of a coil component including the steps of: assembling and forming a coil assembly body in which a coil is attached to a magnetic-body core; and inputting the coil assembly body and a putty-like admixture including magnetic powders and a thermosetting resin into an inner cylindrical portion of a die, further including the steps of: pressing the admixture which is inputted into the inner cylindrical portion, applying vibration for giving shear force with respect to the admixture which is inputted into the inner cylindrical portion for decreasing the viscosity of the aforesaid admixture, and thermosetting and forming the magnetic cover portion by heating an integrated object comprised of the admixture which was applied with the vibration and the coil assembly body and by thermally-curing the thermosetting resin included in the admixture.

Also, for another aspect of the manufacturing method of a coil component of the present invention, it is preferable, in addition to the invention mentioned above, to employ a configuration in which in the step of applying vibration, the vibration is applied to the admixture by an operation of a vibration generating mechanism which applies vibration to the die directly or indirectly.

Further, for another aspect of the manufacturing method of a coil component of the present invention, it is preferable, further in addition to the inventions mentioned above, to employ a configuration in which in the step of applying vibration, the vibration is applied to the admixture by an operation of a percussion mechanism which applies periodic impact to the admixture.

Also, for another aspect of the manufacturing method of a coil component of the present invention, it is preferable, further in addition to the inventions mentioned above, to employ a configuration in which the step of pressing is carried out earlier than the step of applying vibration, and concurrently, the step of pressing is carried out concurrently also in the step of applying vibration.

Further, for another aspect of the manufacturing method of a coil component of the present invention, it is preferable, further in addition to the inventions mentioned above, to employ a configuration in which in the step of applying vibration, the vibration is applied to the admixture by the operation of the vibration generating mechanism which applies vibration to the die directly or indirectly, and concurrently, before or after the vibration application to the admixture by the vibration generating mechanism, the vibration is applied to the admixture by the operation of the percussion mechanism which applies periodic impact to the admixture.

Also, for another aspect of the manufacturing method of a coil component of the present invention, it is preferable, further in addition to the inventions mentioned above, to employ a configuration in which after the step of inputting, a lid member is placed at an upper portion of the admixture, further, a press member is placed at an upper portion of the lid member, in the step of pressing, the admixture is pressurized by operating a pressurizing mechanism which pressurizes the press member, and concurrently, prior to the step of thermosetting and forming, there is carried out a step of ejecting the integrated object from the inner cylindrical portion while maintaining the state in which the upper surface of the integrated object is in close contact with the lid member.

In addition, according to a second viewpoint of the present invention, the present invention is characterized by a mold apparatus for manufacturing a coil component formed by covering a coil assembly body, in which a coil is attached to a magnetic-body core, with a magnetic cover portion, the mold apparatus including: a die provided with an inner cylindrical portion into which the coil assembly body and a putty-like admixture including magnetic powders and a thermosetting resin are inputted; a press member which presses the admixture from the upward side of the die; a pressurizing mechanism which pressurizes the press member; a vibration applying member which applies vibration for giving shear force with respect to the admixture inputted into the inner cylindrical portion; and a control unit which controls the operation of the pressurizing mechanism and the vibration applying member.

According to the present invention, it becomes possible to decrease the filling defect of the admixture.

DESCRIPTION OF THE PREFERRED EMBODIMENTS

First Exemplified Embodiment

Hereinafter, there will be explained a manufacturing method of a coil component 10 and the coil component 10 relating to a first exemplified embodiment of the present invention with reference to the drawings. It should be noted that in the following explanation, the explanation will be done by using the XYZ orthogonal coordinate system if it is necessary. In the XYZ orthogonal coordinate system, "X direction" indicates a direction toward which terminals 43*a*, 43*b* are aligned in line in FIG. 1 in which "X1 side" indicates the right side in FIG. 1 and "X2 side" indicates the left side which is opposite thereto. In addition, "Y direction" indicates a direction toward which the terminals 43*a*, 43*b* stretch on the lower bottom surface 31C in which "Y1 side" indicates the rear side in the picture of FIG. 1 and "Y2 side" indicates the near side in the picture which is opposite thereto. In addition, "Z direction" indicates the axis direction of a pillar-shaped core portion 32 in which "Z1 side" indicates the upper side thereof and "Z2 side" indicates the lower side thereof.

1-1: With Regard to Constitution of Coil Component

Figure 1:
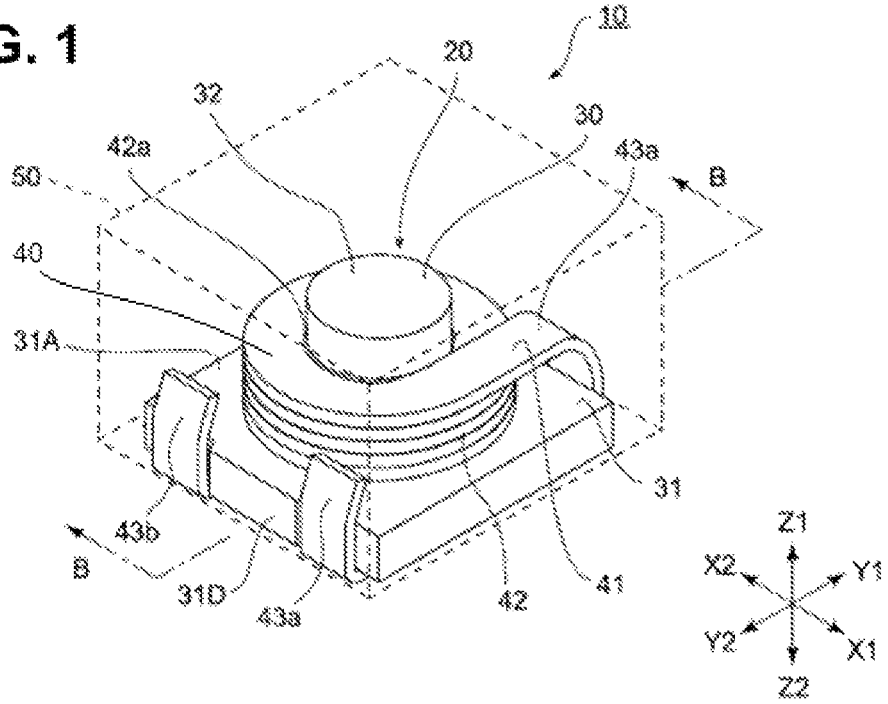
FIG. 1 is a perspective view transparently showing an internal constitution of a coil component relating to a first exemplified embodiment of the present invention.
Figure 2:
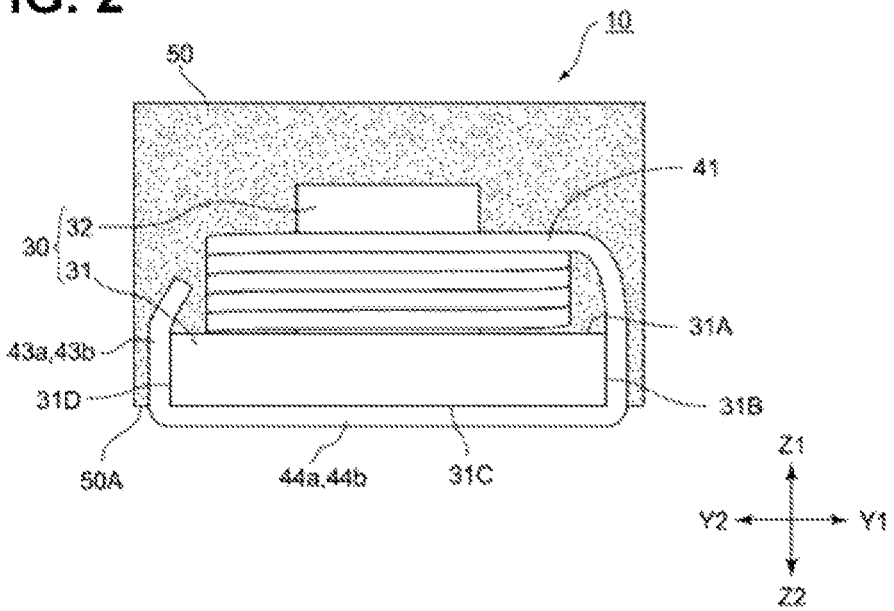
FIG. 2 is a cross-sectional view seen from the reference numerals B-B shown in FIG. 1.

FIG. 1 is a perspective view transparently showing an internal constitution of a coil component 10 relating to a first exemplified embodiment of the present invention. It should be noted in FIG. 1 that a magnetic cover portion 50 is shown by broken lines. In addition, FIG. 2 is a cross-sectional view seen from the reference numerals B-B shown in FIG. 1. In addition, in FIG. 2, there is shown a cross-section of only the magnetic cover portion 50, and a coil assembly body 20 is shown by a side view thereof.

The coil component 10 in the present exemplified embodiment is formed as an electronic component such as an inductor, a transformer, a choke coil or the like. This coil component 10 is formed by including the coil assembly body 20 and the magnetic cover portion 50 as main constituent elements. The coil assembly body 20 includes a magnetic-body core 30 and a coil 40.

The magnetic-body core 30 is provided with a flange portion 31 and a pillar-shaped core portion 32 in which they are provided integrally. Such a magnetic-body core 30 is formed by a material of a ferrite core which is obtained by burning ferrite or of a dust core which is obtained by compression-molding magnetic powders. Here, for the magnetic powders of the dust core, it is possible to use magnetic powders whose main component is iron (Fe) and for which each of silicon (Si) and chromium (Cr) is added by a ratio of 1 wt % or more and also by a ratio of 10 wt % or less. Such magnetic powders are excellent in the aspects of rust-prevention property, relative permeability and the like. From the viewpoint of decreasing the core loss, it is allowed to use metal magnetic powders which are obtained by mixing the above-mentioned magnetic powders with an amorphous metal. For the amorphous metal, it is possible to use a carbon-contained amorphous metal whose main component is iron (Fe), for which each of silicon (Si) and chromium (Cr) is contained by a ratio of 1 wt % or more and also by a ratio of 10 wt % or less, and further, for which carbon (C) is contained by a ratio of 0.1 wt % or more and also by a ratio of 5 wt % or less. In addition, it is also allowed for manganese (Mn) to be contained therein.

The flange portion 31 is provided in a plate shape and according to the constitution shown in FIG. 1, the planar shape of the flange portion 31 forms approximately a square shape. However, the planar shape of the flange portion 31 is not to be limited by the "approximately square shape" and it is possible to employ various kinds of shapes such as a circle shape, an elliptical shape, a polygonal shape and the like. In addition, from the center portion of this flange portion 31, there is provided the pillar-shaped core portion 32 in a standing fashion. The pillar-shaped core portion 32 is formed to be a cylindrical shaped portion stretching so as to be directed to the upward side (Z1 side), but it is allowed to employ a configuration other than the cylindrical shape (to employ polygonal prism such as quadrangular prism or the like). This pillar-shaped core portion 32 is plugged into a coil hole 42*a* of the coil 40 which will be mentioned later.

In addition, for the coil 40, there is used a rectangular wire 41 (corresponding to conductive wire) whose width size is sufficiently larger than the thickness size thereof in which a winding wire portion 42 is formed by winding this rectangular wire 41 and the coil hole 42*a* is provided on the inner circumferential side of that winding wire portion 42. Into this coil hole 42*a*, the pillar-shaped core portion 32 mentioned above is plugged. It should be noted that according to the constitution shown in FIGS. 1 and 2, the winding wire portion 42 is formed by an edgewise winding in which the axis direction of that winding wire portion 42 is provided so as to be in conformity with the axis direction of the pillar-shaped core portion 32. In addition, it is allowed for the lower surface side of the winding wire portion 42 to be fixed with respect to the upper surface of the flange portion 31 by an adhesive agent. For such an adhesive agent, it is possible to use an insulating-resin adhesive agent.

In addition, one terminal 43*a* of the rectangular wire extends from the upper surface side of the winding wire portion 42 toward a direction (Y1 side) in parallel with the upper surface 31A of the flange portion 31 of the magnetic-body core 30 and thereafter, abuts against a side surface 31B on the Y1 side of the flange portion 31 in FIG. 2 in parallel therewith and further, is bent so as to be directed toward the Y2 side while being abutted against the lower bottom surface 31C of the flange portion 31. The portion abutted against this lower bottom surface 31C is exposed downward from the magnetic cover portion and becomes a terminal unit 44*a* which will be electrically connected to another substrate or the like. After going through such a portion which becomes the terminal unit 44*a*, the terminal is bent so as to be directed upward while being abutted against the side surface 31D on the Y2 side of the flange portion 31 and finally, is bent so as to be inclined toward the pillar-shaped core portion 32 side of the flange portion 31.

Similarly, the other terminal 43*b* of the rectangular wire 41 extends from the lower surface side of the winding wire portion 42 toward a direction (Y1 side) in parallel with the upper surface of the flange portion 31 and thereafter, abuts against a side surface 31B on the Y1 side of the flange portion 31 in FIG. 1 in parallel therewith and further, is bent so as to be directed toward the Y2 side while being abutted against the lower bottom surface 31C of the flange portion 31. It should be noted that the portion abutted against this lower bottom surface 31C is exposed downward from the magnetic cover portion 50 and becomes a terminal unit 44*b* which will be electrically connected to another substrate or the like. After going through such a portion which becomes the terminal unit 44*b*, the terminal is bent so as to be directed upward while being abutted against the side surface 31D on the Y2 side of the flange portion 31 and finally, is bent so as to be inclined toward the pillar-shaped core portion 32 side of the flange portion 31.

It should be noted that on the lower bottom surface 31C of the flange portion 31, there are provided groove portions (not shown) so as to rise upward for inducing the terminal units 44*a*, 44*b* to enter thereinto. Each of these groove portions has a shallower depth compared with the thickness of the rectangular wire 41 and each electrode groove houses a portion of the thickness of the terminal unit 44*a* (44*b*). For that reason, it becomes a state in which the downward sides of the terminal units 44*a*, 44*b* protrude downward from the lower bottom surface 31C. It should be noted that it is allowed for the upper surface sides of the terminal units 44*a*, 44*b* to be adhesively fixed onto the wall surfaces of the groove portions by using an adhesive agent.

It should be noted that it is allowed for the conductive wire to use a round wire having a circular cross-section shape instead of the rectangular wire 41 mentioned above. In that case, it is allowed for the terminal units 44*a*, 44*b* to be formed by being crushed into flat shapes.

It should be noted that on the side surface 31D on the Y2 side of the flange portion 31, there are formed side-surface concave portions (not shown) for positioning the terminals 43*a*, 43*b*. For that reason, a portion or all of each thickness of the terminals 43*a*, 43*b* is housed in each of the side-surface concave portions and it becomes possible to prevent the terminals 43*a*, 43*b* from protruding out of the side surface of the flange portion 31. It should be noted that it is allowed to employ a constitution in which with respect to the wall surfaces of the side-surface concave portions, the terminals 43*a*, 43*b* are to be bonded.

Next, there will be explained the magnetic cover portion 50. The magnetic cover portion 50 is formed by a material including magnetic powders and a thermosetting resin. For such a magnetic powder, it is allowed to use the same kind of material as that of the magnetic-body core 30 mentioned above or it is also allowed to use a different material. In addition, it is possible for the thermosetting resin to comprise an epoxy resin, a phenol resin and a silicone resin.

This magnetic cover portion 50 is provided so as to cover the coil assembly body 20 totally except the terminal units 44*a*, 44*b* mentioned above. It should be noted that it is allowed also for the lower bottom surface 31C of the flange portion 31 to be exposed and in addition, it is also allowed for another portion other than the lower bottom surface 31C and the terminal units 44*a*, 44*b* within the coil assembly body 20 to be exposed. As shown in FIG. 1, the magnetic cover portion 50 is provided approximately in a parallelepiped shape. However, it is possible for the shape of the magnetic cover portion 50 to employ an arbitrary shape and the shape thereof is not to be limited by the "approximately parallelepiped shape". Then, the magnetic cover portion 50 is provided so as to cover the pillar-shaped core portion 32 of the magnetic-body core 30 and the winding wire portion 42 of the coil 40.

1-2: with Regard to Constitution of Mold Apparatus

Figure 3:
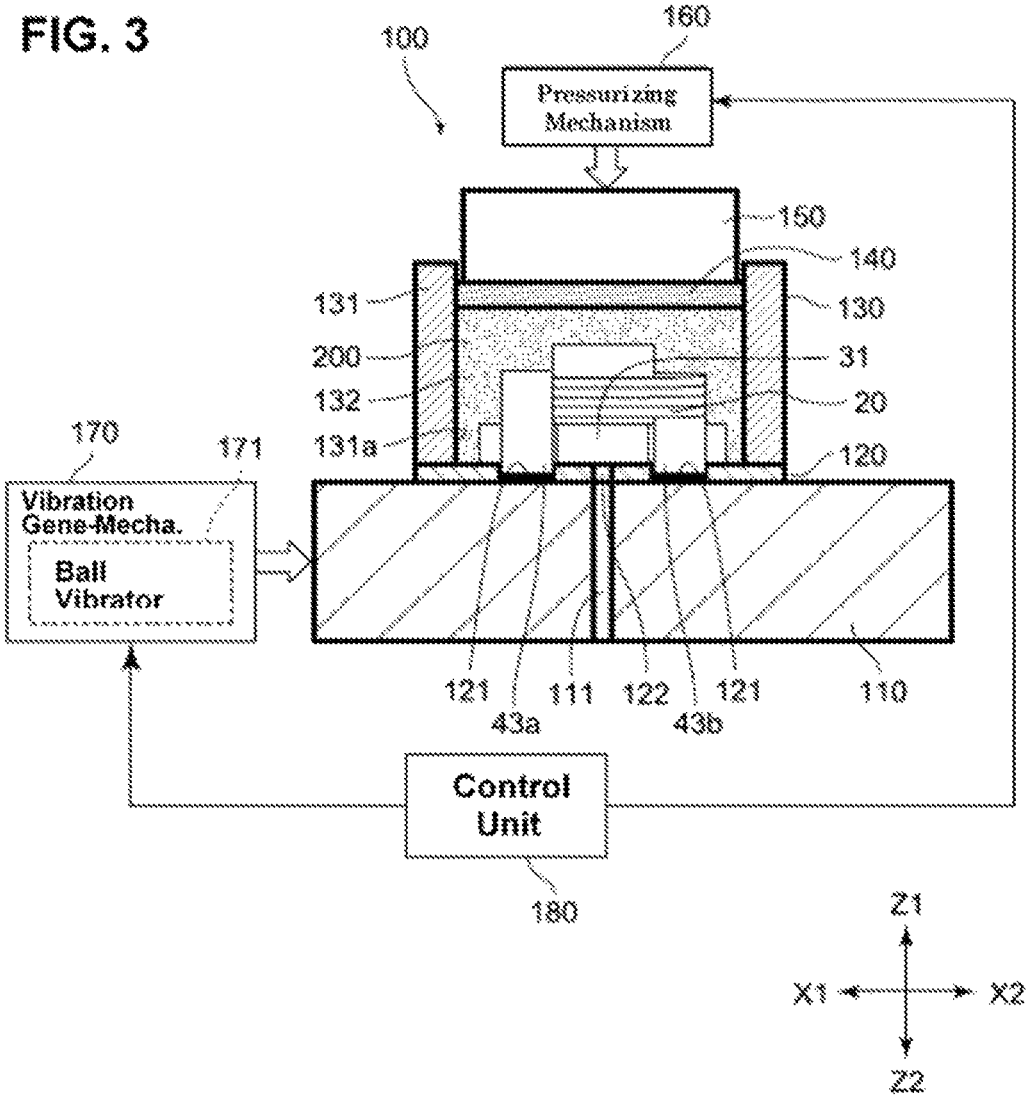
FIG. 3 is a drawing showing a constitution of a mold apparatus used for the manufacturing of the coil component shown in FIG. 1.

Next, there will be explained a constitution of a mold apparatus 100, which is used in order to manufacture the coil component 10, with reference to FIG. 3. FIG. 3 is a drawing showing a constitution of a mold apparatus 100 used for the manufacturing of the coil component 10. As shown in FIG. 3, the mold apparatus 100 includes a base plate portion 110, a lower-side support plate 120, a cylindrical die 130, a lid member 140, a press member 150, a pressurizing mechanism 160, a vibration generating mechanism 170 and a control unit 180, as main constituent elements thereof.

The base plate portion 110 is a portion which becomes a base of the mold apparatus 100 and is a portion for supporting the lower-side support plate 120 and the die 130. In addition, the base plate portion 110 is a portion which is applied with vibration by the vibration generating mechanism 170 which will be mentioned later. Caused by the application of vibration to such a base plate portion 110, the vibration is applied to the admixture 200 which is filled in an inner cylindrical portion 132 of the die 130. It should be noted in the constitution shown in FIG. 3 that there is formed an exhaust hole 111 at the base plate portion 110. This exhaust hole 111 communicates with an insertion hole 122 of the lower-side support plate 120 and it is possible to exhaust air from the inside to the outside of the inner cylindrical portion 132.

The lower-side support plate 120 is a sheet-shaped or thin plate-shaped member and is a portion for sealing the opening portion on the lower side of the inner cylindrical portion 132 of the die 130. This lower-side support plate 120 is provided with positioning concave-portions 121 which are recessed compared with the upper surface of that lower-side support plate 120 and the terminal units 44*a*, 44*b* of the coil assembly body 20 enter into those positioning concave-portions 121. Thus, the position of the coil assembly body 20 with respect to the inner cylindrical portion 132 of the die 130 will be determined.

In addition, the lower-side support plate 120 is provided with the insertion hole 122 and this insertion hole 122 communicates with the exhaust hole 111 mentioned above. For that reason, in a case of pressing the admixture 200 in the inner cylindrical portion 132 of the die 130, it is possible to exhaust the air which exists in the inner cylindrical portion 132 toward the outside through the exhaust hole 111 and the insertion hole 122.

In addition, the die 130 is a member which includes a cylindrical outer cylindrical portion 131 and the portion surrounded by that outer cylindrical portion 131 (portion surrounded by an inner wall 131*a* of the outer cylindrical portion 131) becomes the inner cylindrical portion 132. Then, it becomes a state in which it is possible to place the coil assembly body 20 in this inner cylindrical portion 132, to fill the admixture 200 therein and so on.

It should be noted that the die 130 is positioned with respect to the lower-side support plate 120 through a positioning member which is not shown. For such a positioning member, it is possible to cite, for example, a configuration in which a protrusion is provided at either one of the lower-side support plate 120 and the die 130 and a concave portion fitting into that protrusion is provided at the other one thereof, but it is allowed to use another configuration for the positioning member. In addition, it is preferable for the inner wall 131*a* to be coated with a release agent beforehand. In a case of coating the release agent, it is possible, when carrying out a ejecting-process S50 mentioned later, to easily eject an integrated object formed by molding the admixture 200 and the coil assembly body 20 from the inner cylindrical portion 132.

The lid member 140 is a member which is placed so as to cover the admixture 200 from the upward side (Z1 side) of the inner cylindrical portion 132 after the admixture 200 is filled in the inner cylindrical portion 132. It is preferable for this lid member 140 to be formed by a resin material having excellent mold-release characteristics. For one example of such a resin material, it is possible to use a fluorine resin material such as polytetrafluoroethylene (PTFE) or the like. It should be noted that there is no limitation for the thickness of the lid member 140 in particular, in which it is allowed to employ a member having a so-called sheet shape and other than this shape, a plate shape, a block shape or the like. In addition, the lid member 140 is provided to be approximately the same as the shape of the inner cylindrical portion 132 when planarly viewed and it is possible to press the admixture 200 which is filled in the inner cylindrical portion 132 excellently while preventing the admixture 200 from leaking from the gap between the lid member 140 and the inner wall 131*a* of the outer cylindrical portion 131.

The press member 150 is a member for pressing the lid member 140 from the upward side thereof and is provided to have a smaller diameter than that of the lid member 140. For that reason, it becomes a state in which it is possible to prevent the press member 150 from colliding with the outer cylindrical portion 131. In addition, it is preferable for the press member 150 to be provided to have a larger thickness than that of the lid member 140. It is possible for the press member 150 to use, for example, a block-shaped member.

The pressurizing mechanism 160 is a mechanism for applying a pressing force onto the press member 150 from the upward side of the press member 150. Owing to such a pressurizing mechanism 160, it becomes possible to pressurize the admixture 200 which exists in the inside of the inner cylindrical portion 132. It should be noted that it is allowed to employ a pressurizing mechanism 160 which applies a predetermined pressing force continuously and it is also allowed to employ a pressurizing mechanism which applies a predetermined pressing force periodically.

In addition, the vibration generating mechanism 170 is a mechanism which is attached to the base plate portion 110 and is a mechanism for applying a vibration with respect to that base plate portion 110. The vibration generating mechanism 170 corresponds to the vibration applying member. It is possible for such a vibration generating mechanism 170 to employ, for example, a mechanism using a ball vibrator 171 and a compressor (not shown). The ball vibrator 171 is provided with an iron-steel-made iron ball and a cylindrical case for rotating that iron ball in which there is supplied a compressed air into the inside of the cylindrical case from a compressor. Then, the ball vibrator is an apparatus in which the iron ball rotates at high speed caused by the pressure of the compressed air which is supplied into the inside of the cylindrical case and caused by that action, the vibration is applied to the base plate portion 110.

In this manner, the vibration applied to the base plate portion 110 is applied also to the lower-side support plate 120 and the die 130 and is applied also to the admixture 200. For that reason, the admixture 200 is applied with a shear force and the viscosity thereof will decrease. Caused by that action, it is possible to fill the admixture 200 also into the air gap in the inside of the inner cylindrical portion 132 in which the admixture 200 is not filled.

Here, there is employed a mechanism for the ball vibrator 171 in which the iron ball does not move in a linear direction one-dimensionally but rotates, as mentioned above, in a circle shape in the inside of the cylindrical case. For that reason, the base plate portion 110 is applied with a vibration which is not linear but planar (two-dimensional) caused by the ball vibrator 171. Therefore, the admixture 200 can be filled into the air gap more excellently. It should be noted that it is allowed for the rotational surface formed by the rotation of the iron ball to be set in parallel with the XY plane or it is allowed to employ a situation in which the Z direction is made to become in parallel with the rotational surface such as in a case of XZ plane or ZX plane. In addition, it is also allowed for the ball vibrator to be mounted so as to be inclined with respect to the XY plane, the YZ plane or the ZX plane with a predetermined angle in which there is no limitation for the mounting method thereof.

It should be noted that the vibration generating mechanism 170 is not to be limited by a mechanism which uses the ball vibrator 171. For example, it is allowed for the vibration generating mechanism 170 to use a driving device of such a type in which the vibration is generated by mounting a rotational body onto a motor in an eccentric state and by rotating that rotational body. Besides, it is possible for the vibration generating mechanism 170 to use various types of driving devices such as driving devices of ultrasonic methods, driving devices of such types using electromagnets and the like.

Here, in a case of employing the mounting in a state in which the rotational surface is in parallel with the XY plane or nearly in parallel therewith, the force for vibrating the admixture 200 relatively in the up and down direction will be reduced. For that reason, it is possible to reduce the force in the up and down direction with respect to the admixture 200 which is already pressed toward the up and down direction by the pressurizing mechanism 160.

In addition, the control unit 180 is a portion for controlling the operations of the pressurizing mechanism 160 and the vibration generating mechanism 170.

Figure 4:
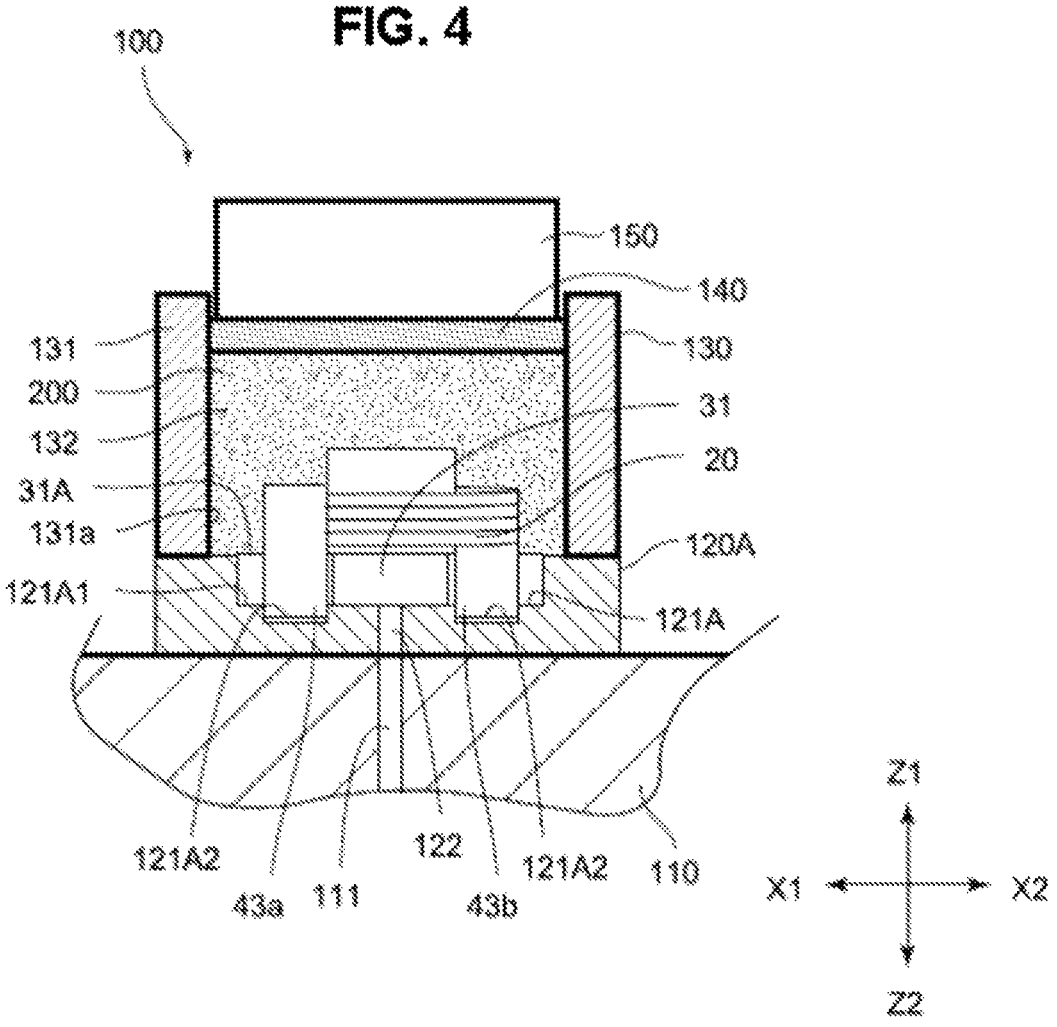
FIG. 4 relates to a modified example of the present invention and is a drawing showing a constitution in which there is shown a lower-side support plate having a large thickness and concurrently, there is provided a positioning concave-portion which is deeply recessed.
Figure 5:
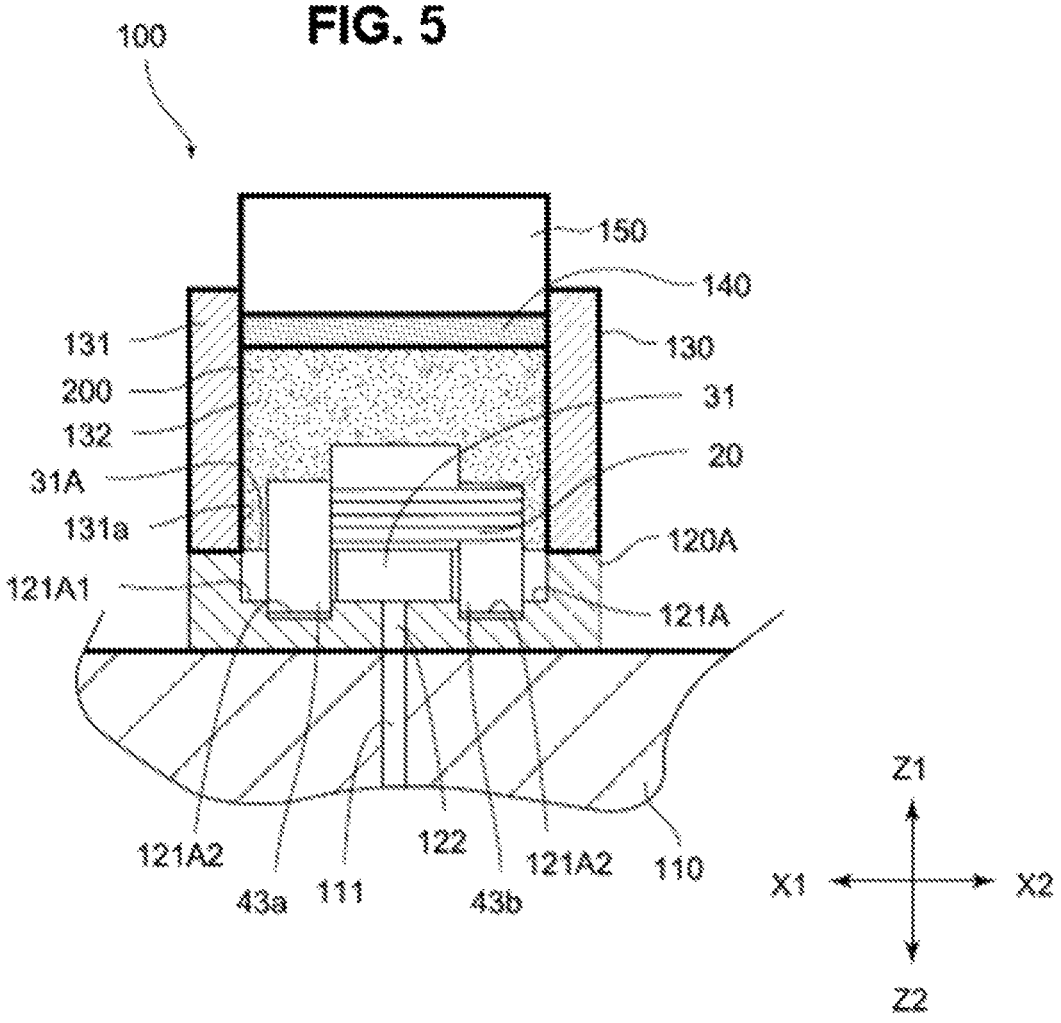
FIG. 5 relates to a modified example of the constitution shown in FIG. 4 and is a drawing showing a constitution in which the outer circumferential surface of a flange portion and the inner wall surface of a die are provided to be flush with each other.

It should be noted that the lower-side support plate 120 is not limited by the constitution shown in FIG. 3. For example, it is also possible to employ the constitutions as shown in FIGS. 4 and 5. FIG. 4 relates to a modified example of the present embodiment and is a drawing showing a constitution in which a lower-side support plate 120A is provided to have a thickness larger than that of the lower-side support plate 120 shown in FIG. 3 and concurrently, is a drawing showing a constitution in which there is provided a positioning concave-portion 121A which is deeply recessed compared with the positioning concave-portion 121.

In the constitution shown in FIG. 4, the positioning concave-portion 121A is provided with a flange concave-portion 121A1 and a terminal concave-portion 121A2. The flange concave-portion 121A1 is a concave portion for making the flange portion enter thereinto in which the area thereof when viewed planarly is provided broadly compared with the terminal concave-portion 121A2. In a state in which the flange portion 31 is made to enter into this flange concave-portion 121A1, the lower surface 50A of the magnetic cover portion 50 protrudes in the X direction compared with the upper surface 31A of the flange portion 31. However, the upper surface 31A of the flange portion 31 is provided so as to become flush with the lower surface 50A of the magnetic cover portion 50.

In a case of manufacturing the coil component 10 by using the lower-side support plate 120A and the die 130 such as shown in FIG. 4, it becomes a state in which the flange portion 31 and the terminals 43*a*, 43*b* protrude toward the downward side from the inner cylindrical portion 132 which is the filling portion of the admixture 200. In addition, it becomes a state in which the flange portion 31 enters into the flange concave-portion 121A1. For that reason, it is possible to reliably form a constitution in which the terminal units 44*a*, 44*b* protrude toward the outside while preventing the admixture 200 from coming around the side of the terminal concave-portion 121A2.

In addition, FIG. 5 relates to a modified example of the constitution shown in FIG. 4 and is a drawing showing a constitution in which the outer circumferential surface of the flange portion 31 and the inner wall surface of the die 130 are provided to be flush with each other. It should be noted that the constitution shown in FIG. 5 is basically in common with the constitution shown in FIG. 4 and therefore, the explanation thereof will be carried out by using the same reference numerals as those explained in FIG. 4. Also in the constitution shown in FIG. 5, there is provided a lower-side support plate 120A whose thickness is larger than that of the lower-side support plate 120. In addition, there are provided a flange concave-portion 121A1 and a terminal concave-portion 121A2 for that lower-side support plate 120A similarly as those mentioned above.

Here, as mentioned above, in the constitution shown in FIG. 5, the outer circumferential surface of the flange portion 31 and the inner wall surface of the die 130 are provided to be flush with each other. For that reason, it is possible to decrease the size of the coil component 10. It should be noted that also in the constitution shown in FIG. 5, it is possible to securely form a constitution in which the terminal units 44*a*, 44*b* protrude toward the outside while preventing the admixture 200 from coming around the side of the terminal concave-portion 121A2.

It should be noted that in the constitution shown in FIG. 5, the die 130 is placed on the upper-side of the lower-side support plate 120A. For that reason, the thickness of the lower-side support plate 120A is provided to be larger. However, it is allowed to employ a constitution in which a similar lower-side support plate 120 as that shown in FIG. 3 is to be used and concurrently, in which the outer circumferential surface of the flange portion 31 is made to be in contact with the inner wall surface 131*a* of the die 130. Also in this case, it is possible to form a coil component 10 having a similar constitution as that of a case in which the die 130 and the lower-side support plate 120A such as shown in FIG. 5 are used.

Figure 6:
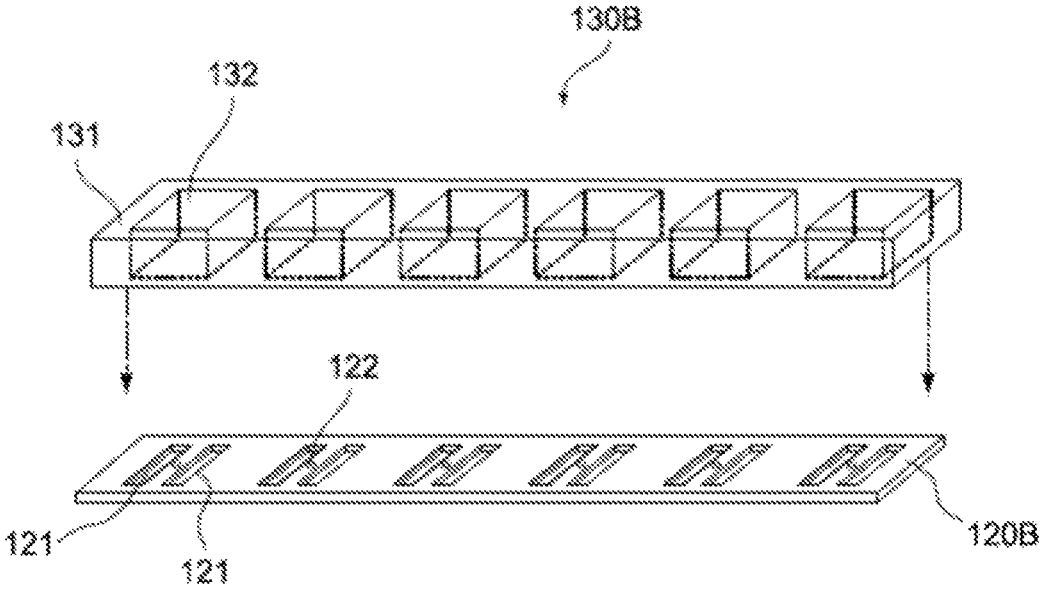
FIG. 6 relates to a modified example of the present invention and is a perspective view in which there are shown multi-dies formed by a plurality of dies integrally interlinked and concurrently, there is shown a multiple support plate having positioning concave-portions, the number of which corresponds to that of the multi-dies.

In addition, the die 130 is not limited by a constitution which includes a single inner cylindrical portion 132. For example, as shown in FIG. 6, it is allowed to use multi-dies 130B in which a plurality of dies 130 are interlinked integrally and concurrently, to use a multiple support plate 120B which includes positioning concave-portions 121 whose number of pieces corresponds to those of the multi-dies 130B. It should be noted that the multi-dies 130B are not limited by a constitution in which the inner cylindrical portions 132 are aligned in a row and it is allowed to employ a constitution in which the inner cylindrical portions 132 are arranged in a planar array shape.

1-3: with Regard to Manufacturing Method of Coil Component

Next, there will be explained, hereinafter, a manufacturing method of the coil component 10 having a constitution as mentioned above. It should be noted that the coil component 10 is manufactured by using the above-mentioned mold apparatus 100. In addition, with regard to each of the processes which will be explained hereinafter, there is no limitation for the sequence or timing thereof by which a plurality of processes are carried out. More specifically, when carrying out the manufacturing method of the coil component 10 of the present exemplified embodiment, it is possible to change the sequence of the plurality of processes thereof within a range in which there is caused no trouble for the content thereof and in addition, it is allowed for a portion or all of the execution timings of a plurality of processes to be overlapped each other.

Figure 7:
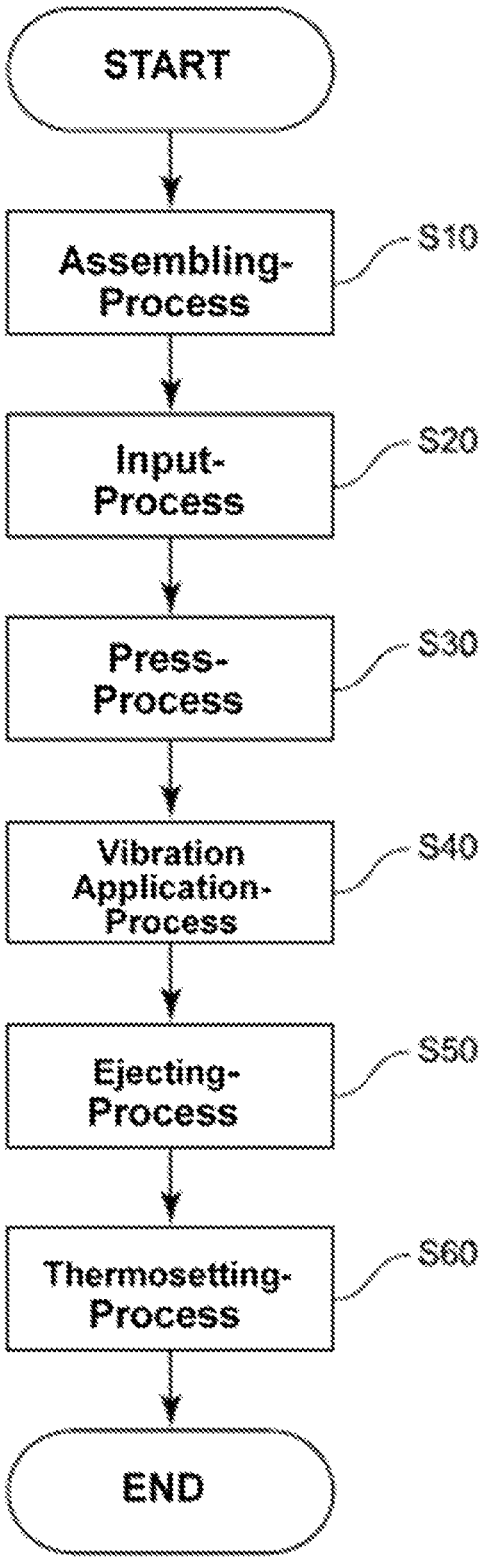
FIG. 7 is a flowchart showing an outline of the manufacturing method of the coil component in the first exemplified embodiment.

FIG. 7 is a flowchart showing an outline of the manufacturing method of the coil component 10 of the present exemplified embodiment. As shown in FIG. 7, in the manufacturing method of the coil component 10, there exist an assembling-process S10, an input-process S20, a press-process S30, a vibration application-process S40, an ejecting-process S50 and a thermosetting-process S60.

(1) Assembling-Process S10

The assembling-process S10 is a process for assembling the coil assembly body 20. In order to carry out such an assembling-process S10, first, the winding wire portion 42 is formed by employing an edgewise bending for the rectangular wire or by bending the rectangular wire 41. Then, the pillar-shaped core portion 32 is inserted with respect to the coil hole 42*a* of the winding wire portion 42. At that time, it is preferable for the lower surface of the winding wire portion 42 to be bonded with the upper surface 31A of the flange portion 31. In addition, the terminals 43*a*, 43*b* of the rectangular wire 41 are bent such as mentioned above. Thus, there will be formed the terminal units 44*a*, 44*b*, in which the insulating coatings of the terminal units 44*a*, 44*b* will be removed if necessary. Thus, also the coil assembly body 20 will be formed.

(2) Input-Process S20

Next, the input-process S20 is carried out. In this input-process S20, the coil assembly body 20 is placed on the lower-side support plate 120 in the inside of the inner cylindrical portion 132, and concurrently, the admixture 200 is inputted into the inside of the inner cylindrical portion 132. At that time, caused by a configuration in which the terminal units 44*a*, 44*b* are made to enter into the positioning concave-portions 121, the coil assembly body 20 is positioned in the inside of the inner cylindrical portion 132.

Here, the admixture 200 is a putty-like admixture obtained by mixing metal-made magnetic powders and a resin and by adding a solvent thereto. For that reason, for example, in a case of forming the admixture 200 to have a certain shape, it becomes a state in which the viscosity thereof becomes an identical or similar viscosity as that of clay and in which the shape thereof can be maintained. It should be noted that the magnetic cover portion 50 is formed by the admixture 200 and therefore, the magnetic powders and the resin have the same material properties as those of the above-mentioned magnetic cover portion 50. In addition, it is possible for the solvent to arbitrarily utilize a well-known organic solvent such as acetone, MEK (methyl ethyl ketone), ethanol, α-Terpineol, IPA (isopropyl alcohol) or the like.

It should be noted that it is possible to obtain a specific admixture 200 by mixing the metal magnetic powders and the epoxy resin under a condition in which the composition ratio there-between is selected as 91:9 to 95:5 (including both of the end-values) by mass-ratio. Further, it is possible to prepare the admixture by adding the solvent selectively. For one example of the metal magnetic powders, it is possible to cite powders in which amorphous metal magnetic powders containing at least iron, silicon, chromium and carbon are mixed with iron-silicon chromium based alloy powders by mass-ratio 1:1.

In addition, it is possible to use a terpineol for the solvent which is added to the admixture 200 in which the additive amount of the solvent is made to be less than 2 wt % with respect to the mass of the admixture 200. Thus, it is possible to set the admixture 200 in a putty state having low fluidity. At that time, the viscosity of the admixture 200 becomes within a range of 30 Pa·s to 3000 Pa·s.

In addition, in a case of inputting the admixture 20 into the cylindrical portion 132, a block body of the admixture 200 is formed beforehand so as to obtain a proper amount of the admixture 200 and, in addition, so as to form a shape which is easily inputted to the inner cylindrical portion 132. Then, after placing the coil assembly body 20 on the lower-side support plate 120, the block body of the admixture 200 is placed on the upper portion of the coil assembly body 20.

(3) Press-Process S30

Next, the press-process S30 is carried out. In this press-process S30, the lid member 140 is placed on the upper portion of the admixture 200 and further, after placing the press member 150 on the upper portion of the lid member 140, the pressurizing mechanism 160 is activated. Thus, the admixture 200 is made to enter into the gap existing in the inside of the inner cylindrical portion 132.

It should be noted that the press-process S30 of the present exemplified embodiment means a process in which the inner cylindrical portion 132 is filled with the admixture 200 without changing the volume of the admixture 200 eliminating the air gap thereof. For that reason, the press-process S30 is designed to be different from a well-known compression-process in which the processed-object such as ferrite or the like is compressed by high pressure and the volume thereof is reduced significantly. While a high pressing force of around 0.5 tons to a few tons is generally loaded onto the processed-object in such a well-known compression-process, it is enough in the press-process S30 of the present exemplified embodiment if a low pressing pressure of, for example, around 0.5 kg to 50 kg is to be loaded onto the admixture 200. Therefore, also the damage to the die 130 becomes less and due to this effect, there can be obtained such a merit that the selective range of the material for the die 130 will be widened.

(4) Vibration Application-Process S40

The vibration application-process S40 is a process for applying vibration to the admixture 200. It should be noted that in this vibration application-process S40, the pressurizing mechanism 160 maintains the state in which the press member 150 and the lid member 140 are pressurized. Here, it is allowed to comprehend that the continuation of this pressurized state is a continuation of the press-process S30 and it is also allowed to comprehend that the continuation is a portion of the vibration application-process S40. In this pressurized state, the vibration generating mechanism 170 is controlled so as to be activated by the control unit 180. Then, the vibration is applied to the base plate portion 110 and that vibration is also transmitted to the admixture 200.

It should be noted with regard to the vibration applied by such a vibration generating mechanism 170 that the amplitude thereof is designed to be within a range of 0.1 μm to 1 cm. In addition, the frequency of the applied vibration is designed to be within a range of 2 Hz to 500 Hz. Further, the time period for exciting the vibration generating mechanism 170 is designed to be within a range of 1 second to 100 seconds. In addition, the exciting period is not to be limited by the above-mentioned range either and it is allowed to design the exciting period to be, for example, more than 100 seconds.

Here, when adding the vibration to the admixture 200, the viscosity thereof decreases rapidly. For that reason, it is possible to fill also the air gap, which is not filled with the admixture 200 inside the inner cylindrical portion 132, with the admixture 200 by pressurizing the admixture 200 under such a condition as mentioned above in a state in which the viscosity of the admixture 200 is made to decrease rapidly.

(5) Ejecting-Process S50

Next, the ejecting-process S50 is carried out. In this ejecting-process S50, the integrated object of the admixture 200 and the coil assembly body 20 is ejected from the inside of the inner cylindrical portion 132. At that time, the top surface portion of the admixture 200 is in close contact with the lid member 140 and therefore, it is possible to eject the integrated object in a state in which the upper surface of the integrated object is in close contact with the lid member 140 by pushing the integrated object upward, for example, by inserting a pin shaped push-up member into the positioning concave-portion 121.

(6) Thermosetting-Process S60

Next, the thermosetting-process S60 is carried out. In this thermosetting-process S60, the admixture 200 in the ejected integrated object is thermally-cured by being heated up to the thermosetting temperature or more. At that time, the solvent included in the admixture 200 is removed by being volatilized. Then, after a state in which the admixture 200 is cured sufficiently and becomes a magnetic cover portion 50, the lid member 140 is removed from the upper surface of the integrated object. Thus, the coil component 10 is formed.

(7) Other Processes, Modified Exemplified Embodiments, Etc.

It should be noted with regard to the ejecting-process S50 and the thermosetting-process S60 that it is allowed to employ the following configurations. More specifically, it is allowed, before carrying out the ejecting-process S50, to carry out the thermosetting-process S60 in a state in which the integrated object is filled in the inner cylindrical portion 132. Then, it is allowed, after curing the integrated object completely in the thermosetting-process S60, to carry out the ejecting-process S50.

In addition, it is allowed to employ the following processes. More specifically, the thermosetting-process S60 of a first stage is carried out by a first temperature before carrying out the ejecting-process S50, in which the admixture 200 of the integrated object is to be semi-cured. At that time, while the first temperature is selected to be less than the thermosetting temperature of the thermosetting resin, the first temperature is made to be a temperature by which the solvent included in the admixture 200 is volatilized so as to semi-cure the integrated object. Thereafter, the ejecting-process S50 is carried out and the integrated object including the semi-cured admixture 200 is ejected from the inner cylindrical portion 132. Then, the thermosetting-process S60 of a second stage is carried out at a second temperature which is higher than the first temperature. At that time, the second temperature is made to be equal to the thermal-cure temperature of the thermosetting resin or more. Here, it is allowed to set the first temperature to be equal to the curing start temperature of the thermosetting resin or more and also to be less than the completely cured temperature.

In addition, it is allowed to carry out a post-treatment process after carrying out the thermosetting-process S60. For the post-treatment process, there can be cited such as a polishing process of the surface of the magnetic cover portion 50, a coating-formation process by using a thermosetting resin, or the like.

1-4: with Regard to Effects

According to the manufacturing method of the coil component 10 as described above, it becomes possible to prevent the portion such as an air gap which is not filled with the admixture 200 from being formed in the inner cylindrical portion 132 of the die 130. More specifically, the putty-like admixture 200 has a high viscosity and is inferior in fluidity, so that even if the admixture 200 inputted into the inner cylindrical portion 132 is pressurized, there is a fear that a place which is not sufficiently filled with the admixture 200 sufficiently (filling defect) is caused in the inside of the inner cylindrical portion 132.

However, in the present exemplified embodiment, after the admixture 200 is inputted into the inner cylindrical portion 132 in the press-process S30, there is applied a vibration for applying such a shear force which decreases the viscosity of the admixture 200 by carrying out the vibration application-process S40. For that reason, the viscosity of the putty-like admixture 200 is decreased and the fluidity thereof is improved. Thus, it becomes possible to prevent the place which is not filled with admixture 200 (filling defect) in the inside of the inner cylindrical portion 132 from being formed. Therefore, it becomes possible to prevent from occurring quality fluctuation (fluctuation in an aspect of characteristics) of the coil component 10 which was formed passing through the ejecting-process S50, the thermosetting-process S60 and like, thereafter.

In addition, in the vibration application-process S40 of the present exemplified embodiment, the vibration is applied to the putty-like admixture 200 by an operation of the vibration generating mechanism 170 which applies the vibration with respect to the die 130 directly or indirectly. For this reason, it becomes possible to apply the vibration to the putty-like admixture 200 excellently and it becomes possible to prevent the place which is not filled with the admixture 200 (filling defect) in the inside of the inner cylindrical portion 132 from being formed more reliably.

In addition, in the present exemplified embodiment, the press-process S30 is carried out earlier than the vibration application-process S40 and at the same time, it is possible, also in the vibration application-process S40, to carry out the press-process S30 concurrently. In a case of employing such a procedure, the vibration is added to the putty-like admixture 200 in a pressurized state, so that it becomes possible to prevent the place which is not filled with the admixture 200 (filling defect) in the inside of the inner cylindrical portion 132 from being formed more reliably.

In addition, in the present exemplified embodiment, after the input-process S20, the lid member 140 is placed at an upper portion of the admixture 200, further, the press member 150 is placed at an upper portion of the lid member 140. Then, in the press-process S30, the admixture 200 is pressurized by operating the pressurizing mechanism 160 which pressurizes the press member 150, and concurrently, prior to the thermosetting-process S60, there is employed a configuration in which the ejecting-process S50 of ejecting the integrated object from the inner cylindrical portion 132 is to be carried out while maintaining the state in which the upper surface of the integrated object is in close contact with the lid member 140.

For this reason, it is possible in the ejecting-process S50 to carry out the ejection which uses the lid member 140 without taking out the integrated object directly and therefore, after that ejection, it is possible also when conveying the integrated object to carry out the conveyance which uses the lid member 140. In addition, it is possible also when thermosetting the admixture 200 in the thermosetting-process S60 to carry out the thermosetting which uses the lid member 140. Therefore, the handling of the integrated object becomes easy. In addition, in each process after the ejection of the integrated object, it becomes unnecessary to hold the integrated object directly and, therefore, it becomes possible to prevent the outer surface of the integrated object (admixture 200) from being damaged.

In addition, in the present embodiment, the mold apparatus 100 which is used for manufacturing the coil component 10 includes the press member 150 which presses the admixture 200 from the upward side of the die 130 and the pressurizing mechanism 160 which pressurizes that press member 150; and concurrently, includes the vibration generating mechanism 170 which applies vibration for giving shear force with respect to the admixture 200 inputted into the inner cylindrical portion 132. Further, the operations of the vibration generating mechanism 170 and the pressurizing mechanism 160 are controlled by the control unit 180. For this reason, it becomes possible to activate the vibration generating mechanism 170 under a suitable condition and, similarly, it is also possible to activate the pressurizing mechanism 160 under a suitable condition. For that reason, it becomes possible to prevent the place which is not filled with the admixture 200 (filling defect) in the inside of the inner cylindrical portion 132 from being formed more reliably.

Second Exemplified Embodiment

Figure 8:
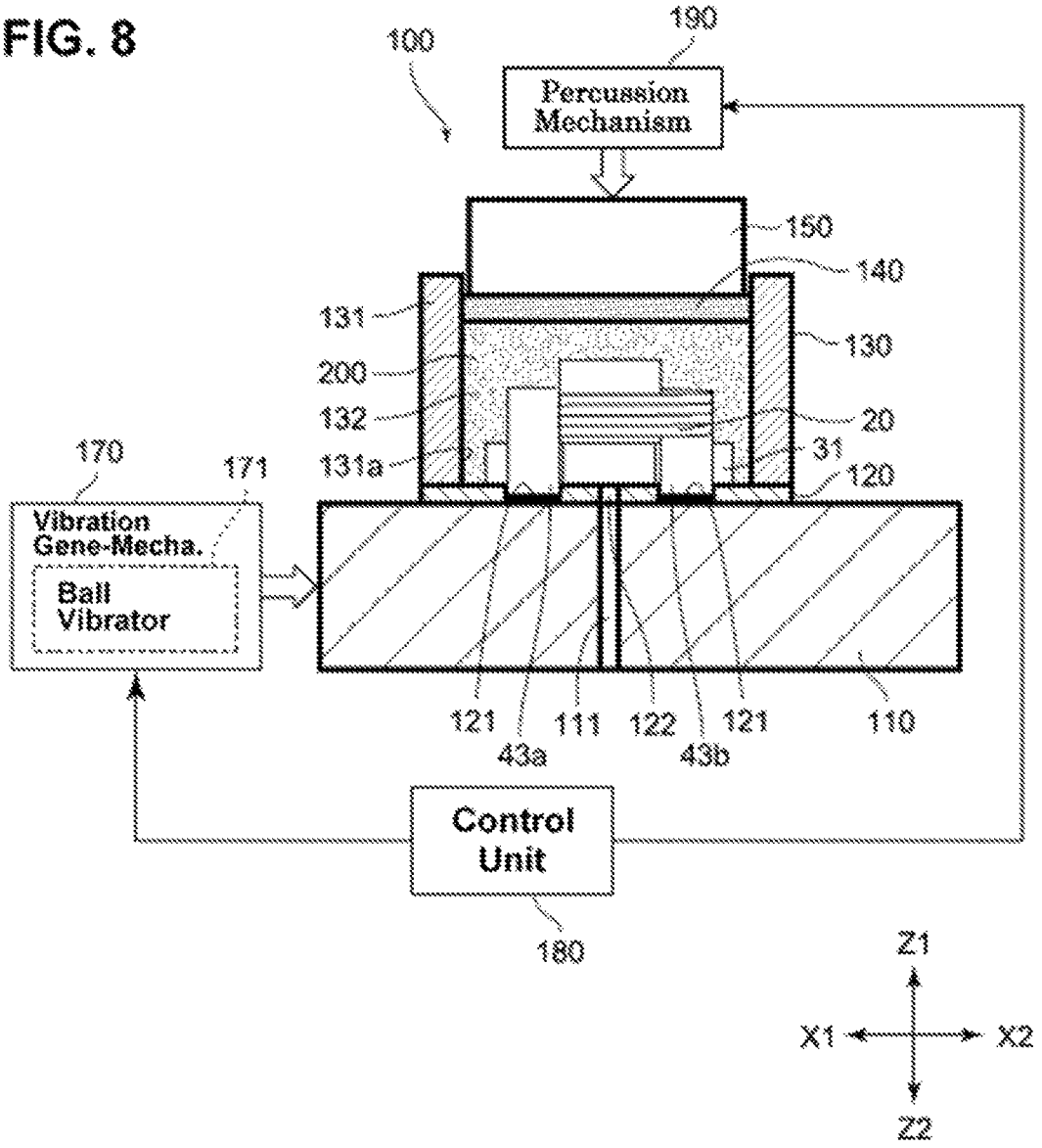
FIG. 8 relates to a second exemplified embodiment of the present invention and is a drawing showing a constitution of a mold apparatus used for the manufacturing of the coil component.

Next, there will be explained a second exemplified embodiment of the present invention. FIG. 8 relates to a second exemplified embodiment of the present invention and a drawing showing a constitution of a mold apparatus 100 used for the manufacturing of the coil component 10. The constitution of the mold apparatus 100, which is shown in FIG. 8, has basically a similar constitution as that of the mold apparatus 100 in FIG. 3 mentioned above. For that reason, in the following explanation, it is supposed that there will be explained portions which are different from those of the mold apparatus 100 in the above-mentioned first exemplified embodiment.

2-1: With Regard to Constitution of Mold Apparatus

The mold apparatus 100 of the present exemplified embodiment includes a percussion mechanism 190 instead of the pressurizing mechanism 160. The percussion mechanism 190 corresponds to the vibration applying member. The percussion mechanism 190 is a mechanism which includes a percussion member for applying a percussion to the press member 150 and a drive member for driving that percussion member, and is a mechanism which applies a periodic percussion to the admixture 200 through the press member 150 and the lid member 140. In addition, with respect to the percussion mechanism 190, the drive thereof is controlled by the control unit 180.

It should be noted that the term "percussion" used here means that the percussion member will repeat actions of getting-away, colliding and the like with respect to the press member 150. On the other hand, the vibration generating mechanism 170 mentioned above is a mechanism which applies a vibration in a state of being attached without being apart from the base plate portion 110. For that reason, there is a difference between the percussion mechanism 190 and the vibration generating mechanism 170 in such an aspect of whether or not the mechanism will get-away periodically with respect to the target object to which a periodic vibration is applied.

In addition, in a case of applying the percussion to the press member 150 by activating the percussion mechanism 190 as shown in FIG. 8, it becomes a state in which the admixture 200 is to be pressurized instantaneously. For that reason, it becomes possible for the mold apparatus 100 of the present exemplified embodiment to omit the provision of the pressurizing mechanism 160. However, it is allowed for the mold apparatus 100 of the present exemplified embodiment to employ a constitution provided with the pressurizing mechanism 160 together with the percussion mechanism 190.

In addition, in the mold apparatus 100 shown in FIG. 8, there is employed a constitution provided with the vibration generating mechanism 170 together with the percussion mechanism 190. However, in a case in which it is possible to decrease the viscosity of the admixture 200 sufficiently by the percussion mechanism 190, it is possible for the mold apparatus 100 to employ a constitution in which there is not provided the vibration generating mechanism 170.

Meanwhile, when an impact such as a percussion is applied to a target object including the press member 150, a vibration in response to the natural vibration frequency of that target object continues for a short period while being attenuated. When such an impact is applied periodically, it becomes a state in which the vibration is applied to the admixture 200 and it becomes possible to decrease the viscosity thereof.

The percussion frequency which is applied by the percussion mechanism 190 is made to be within a range of 2 Hz to 500 Hz similarly as that of the above-mentioned vibration mechanism 170. Further, the period for which the percussion is applied to the percussion mechanism 190 is made to be within a range of one-second to one-hundred seconds. However, if it is possible to decrease the viscosity of the admixture 200, there is no limitation for such a range and it is allowed to employ another range.

2-2: With Regard to Manufacturing Method of Coil Component by Using the Above-mentioned Mold Apparatus In a case of manufacturing the coil component 10 by using the mold apparatus 100 as shown in FIG. 8 and as explained above, the coil component is basically manufactured similarly according to the manufacturing method of the coil component 10 in the first exemplified embodiment mentioned above. At that time, the activation of the percussion mechanism 190 corresponds to the execution of the vibration application-process S40. However, in a case of employing a constitution in which there is an omission of providing the pressurizing mechanism 160 in the mold apparatus 100, the percussion mechanism 190 becomes a state of carrying out the press-process S30 other than the vibration application-process S40. At that time, it is allowed to comprehend that the percussion mechanism 190 carries out the press-process S30 first, presses the admixture 200 into the inner cylindrical portion 132 and thereafter carries out the vibration application-process S40, and it is also allowed to comprehend that the percussion mechanism 190 carries out the press-process S30 and the vibration application-process S40 simultaneously.

2-3: with Regard to Effects

In a case of manufacturing the coil component 10 by using the mold apparatus 100 having a constitution as described above, in the vibration application-process S40, the vibration is applied to the admixture 200 by an operation of the percussion mechanism 190 which applies periodic impact to the admixture 200. Even if employing such a procedure, it becomes possible to decrease the viscosity of the admixture 200 and due to this fact, it becomes possible to prevent the place which is not filled with the admixture 200 (filling defect) in the inside of the inner cylindrical portion 132 from being formed.

In addition, in the present exemplified embodiment, for the vibration application-process S40, it is allowed to employ a constitution in which the vibration is applied to the admixture 200 by the operation of the vibration generating mechanism 170 which applies vibration to the die 130 directly or indirectly, and concurrently before or after the vibration application to the admixture 200 by the vibration generating mechanism 170, the vibration is applied to the admixture 200 by the operation of the percussion mechanism 190 which applies periodic impact to the admixture 200.

In a case of employing such a constitution, it becomes possible to apply two kinds of vibrations, whose vibration modes are different, with respect to the admixture 200 and due to this fact, it becomes possible to prevent the place which is not filled with the admixture 200 (filling defect) in the inside of the inner cylindrical portion 132 from being formed more reliably. In particular, even if there occurs a filling defect which cannot be prevented by a single kind of vibration mode, it becomes possible by applying another kind of vibration mode to prevent the air gap in the putty-like admixture 200 from being caused more reliably.

Modified Examples

As described above, there were explained respective exemplified embodiments of the present invention, but it becomes possible for the present invention to be modified variously departing from those embodiments above. Hereinafter, there will be explained certain of those modifications.

In each of the above-mentioned exemplified embodiments, the multi-dies 130B are formed as a single integrated object in which a plurality of inner cylindrical portions 132 are formed. However, it is allowed for the multi-dies to employ an object which is divided, for example, into two pieces.

In addition, in the above-mentioned each exemplified embodiment, it is made to have a constitution in which the vibration generating mechanism 170 shown in FIG. 8 is attached to the base plate portion 110 and the vibration is applied to this base plate portion 110. However, it is allowed for the vibration generating mechanism 170 to employ a constitution in which the vibration is applied to the admixture 200 by employing a constitution in which the mechanism 170 is directly attached to the die 130 or the multi-dies 130B, or is directly attached to the lower-side support plate 120, 120A or the multiple support plate 120B. In addition, even if designing a constitution in which the vibration generating mechanism 170 is attached to another portion other than those above, it is allowed to employ such a constitution if it is possible to transmit the vibration to the admixture 200 excellently.

In addition, in the above-mentioned second exemplified embodiment, there is employed a constitution in which the percussion mechanism 190 applies the impact to the press member 150 and in which short periodic vibrations caused by that impact are applied to the admixture 200. However, it is allowed for the percussion mechanism 190 to employ a constitution in which the viscosity of the admixture 200 is decreased by applying the impact, for example, to the base plate portion 110 or to another portion.

In addition, in the above-mentioned each exemplified embodiment, it is allowed for the vibration which is applied to the admixture 200 by the vibration generating mechanism 170 or the percussion mechanism 190 to make the frequency, the amplitude or the vibration period thereof variable. For example, it is allowed not to employ a constitution in which a constant frequency or amplitude is applied during the execution of the application-process S40 but to employ a constitution in which the frequency or the amplitude is changed appropriately during the period of executing the vibration application-process S40. For example, it is also allowed for the control unit 180 to control the operation of the vibration generating mechanism 170 and/or the percussion mechanism 190 such that the vibration having a low frequency is applied in the beginning and thereafter, the vibration having a higher frequency than that in the beginning is applied to the admixture 200.

In addition, in a case of vibrating the admixture 200, the energy applied to the admixture becomes maximum when a resonance is caused and therefore, it is allowed to employ a constitution in which there is provided a separate vibration sensor for detecting vibration or a sound sensor such as a microphone in a case of generating vibration sound on an occasion of vibration and, based on the detection results by those sensors, the operation of the vibration generating mechanism 170 and/or the percussion mechanism 190 is to be controlled in the control unit 180. In addition, it is also allowed to employ such a constitution in which the control unit 180 will control the operation period of the vibration generating mechanism 170 and/or the percussion mechanism 190 in response to the ambient temperature, the humidity or the like.

Having described preferred embodiments of the invention with reference to the accompanying drawings, it is to be understood that the invention is not limited to those precise embodiments and that various changes and modifications could be effected therein by one skilled in the art without departing from the scope of the invention as defined in the appended claims.

What is claimed is:

1. A mold apparatus for manufacturing a coil component comprising:

a support plate, the support plate having an insertion hole therein;

a base plate disposed under the support plate, the base plate having an exhaust hole therein;

a vibrator connected to the base plate and configured to vibrate the base plate;

a die that is disposed on the support plate, the die having a peripheral side wall defining an opening opposite the support plate, the coil component being placeable in an inner space of the die interior of the side wall;

a lid that is configured to be inserted via the opening of the die into the inner space of the die with an outer peripheral edge of the lid slidably received by an inner surface of the side wall of the die;

a press member that is configured to abuttingly engage the lid so as to press the lid toward the support plate;

a press mechanism that is operatively connected to the press member; and a controller electrically connected to the press mechanism and the vibrator, the controller being configured to control the press mechanism and the vibrator, wherein the inner space of the die is fluidly connected to an exterior of the die via the insertion hole and the exhaust hole, the vibrator comprises one of:

a ball vibrator;

an ultrasonic vibrator; and an electromagnetic vibrator, when the vibrator vibrates the base plate, part of the coil component covers an opening of the insertion hole in the support plate, and the controller is configured to activate the vibrator when the press mechanism operates the press member to press the lid and apply a pressure on a content in the inner space of the die.

2. The mold apparatus according to claim 1, wherein the support plate has a recess in a surface of the support plate facing the inner space of the die, the recess being configured to accommodate a terminal of the coil component.

3. The mold apparatus according to claim 1, wherein the lid comprises a resin material having a mold-release property.

4. The mold apparatus according to claim 3, wherein the resin material is a fluorine resin.

5. The mold apparatus according to claim 4, wherein the fluorine resin is polytetrafluoroethylene.

6. The mold apparatus according to claim 1, wherein the outer peripheral edge of the lid abuttingly engages the inner surface of the side wall to obstruct material leakage from the inner space of the die.

7. The mold apparatus according to claim 1, wherein an abutting surface of the press member contacts an abutted surface of the lid, and the abutting surface of the press member has a smaller surface area than the abutted surface of the lid.

8. The mold apparatus according to claim 1, wherein the press member has a larger height than the lid.

9. The mold apparatus according to claim 1, wherein the ball vibrator is configured to rotationally move a ball.

10. The mold apparatus according to claim 1, wherein the support plate has a positioning recess in a surface of the support plate facing the inner space of the die, the positioning recess is configured to accommodate part of a core of the coil component, and an entirety of the positioning recess faces the inner space.

11. The mold apparatus according to claim 1, wherein the support plate has a positioning recess in a surface of the support plate facing the inner space of the die, the positioning recess is configured to accommodate part of a core of the coil component, and a perimeter of the positioning recess is coextensive with the side wall of the die.

12. The mold apparatus according to claim 1, further comprising:

a monolithic body integrally provided with a plurality of the dies.

* * * * *